US006609571B2

(12) United States Patent
Nice et al.

(10) Patent No.: US 6,609,571 B2
(45) Date of Patent: Aug. 26, 2003

(54) REMOTE SUB-SEA LUBRICATOR

(75) Inventors: Sidney Basil Nice, Humble, TX (US); Freeman Lee Hill, Houston, TX (US)

(73) Assignee: Baker Hughes, Incorporated, Houston, TX (US)

( * ) Notice: Subject to any disclaimer, the term of this patent is extended or adjusted under 35 U.S.C. 154(b) by 0 days.

(21) Appl. No.: 09/819,316

(22) Filed: Mar. 28, 2001

(65) Prior Publication Data

US 2002/0139535 A1 Oct. 3, 2002

(51) Int. Cl.[7] ..... E21B 43/01; E21B 33/038
(52) U.S. Cl. ..... 166/342; 166/241.5; 166/368
(58) Field of Search ..... 166/338, 339, 166/342, 349, 360, 85.3, 168, 241.5, 368

(56) References Cited

U.S. PATENT DOCUMENTS 3,517,736 A * 6/1970 Waldron ..... 166/351
3,532,163 A * 10/1970 Ecuer ..... 166/53
4,673,041 A * 6/1987 Turner et al. ..... 166/340
4,993,492 A * 2/1991 Cressey et al. ..... 166/339
5,893,417 A * 4/1999 Pizzolato ..... 166/377

FOREIGN PATENT DOCUMENTS

WO WO 97/04211 A1 * 6/1997 ..... E21B/33/035

* cited by examiner

*Primary Examiner*—David Bagnell
*Assistant Examiner*—Daniel P. Stephenson
(74) *Attorney, Agent, or Firm*—Darryl M. Springs; Keith R. Derrington

(57) ABSTRACT

The present invention involves a remote sub sea lubricator assembly for inserting a wireline tool into a sub sea well comprising an elongated tube having an axial passage formed therethrough for receiving the wireline tool. The remote sub sea lubricator is lowered beneath the surface of the sea for connection to a sub sea well. Contained within the lubricator is the wireline tool. Once connected to the sub sea well, the wireline tool is released from the lubricator into the well. The lubricator enables the wireline tool to enter and exit the well without sea water entering the well.

17 Claims, 3 Drawing Sheets

REMOTE SUB-SEA LUBRICATOR

BACKGROUND OF THE INVENTION

1. Field of the Invention

The invention relates generally to the field of oil and gas well wireline operations. More specifically, the present invention relates to a method and apparatus to enhance the ability of wireline operations in deep water wells.

2. Description of Related Art

Many wireline procedures exist today for use in hydrocarbon producing well bores. These procedures include, well logging, well perforating, and plug setting. Often times wireline procedures are performed after the well has been completed and thus the well drilling equipment has been removed from the well. While this is not a problem regarding hydrocarbon producing well bores that are located on the earth's surface, wells that are located on the sea floor can be problematic, especially wells that are in ultra-deep waters (from about 1000 feet in depth in excess of 10,000 feet in depth). While a drilling rig can be used in wireline operations for sub-sea wells moving an off shore drilling rig back to a well site specifically for wireline operations after the well has already been drilled is very expensive. Because of the expense of owning and operating offshore drilling rigs, once the offshore drilling rig has completed drilling a well, the rig is generally relocated to the next drilling site. Because wireline operations are often performed to maintain sub-sea wells in their optimum producing capabilities, and because wireline operations generally occur well after the wells have been drilled and the offshore drilling rig has been moved to another location, a method and apparatus is needed that enables the use of wireline operations (including coiled or conductor tubing) on sub-sea hydrocarbon producing wells, without requiring the use of an offshore drilling rig.

BRIEF SUMMARY OF THE INVENTION

The present invention involves a remote sub sea lubricator assembly for inserting a wireline tool into a well through a sub sea well head. The remote sub sea lubricator assembly comprises an elongated tube having an axial passage formed therethrough for receiving the wireline tool. The elongated tube preferably has a circular cross section, and is typically approximately 20 feet in length. However, because the elongated tube must accommodate the specific wireline tool, the length of the elongated tube can exceed 100 feet. As far as the inner diameter of the elongated tube, while that value can vary, it must be of sufficient diameter to enable free passage of the wireline tool therethrough. The elongated tube has a top end, a bottom end, an inside and an outside and the wireline tool is attached to a wireline. The sub sea well head is connected to a well bore at the sea floor.

The top end of the remote sub sea lubricator provides an aperture for receiving the wireline and has a sealing means for producing a sealing contact between the aperture and the wireline passed therethrough. The sealing means prevents pressure communication across the aperture while allowing free passage of the wireline through the aperture. The top end of the remote sub sea lubricator is detachable, and preferably threadingly attached to the elongated tube, although the top end can be attached to the rest of the remote sub sea lubricator can also be attached with flanged or bolted fittings. The bottom end of the remote sub sea lubricator is formed to coaxially mate with the sub sea well head, this provides pressure communication between the axial passage of the elongated tube and the well bore.

The wireline tool is releasably secured to the inside of the remote sub sea lubricator, where the securing means can be actuated to obstruct free passage of the wireline tool through the elongated tube and alternatively can be actuated to allow free passage of the wireline tool through the elongated tube. The securing means can be comprised of a full port ball valve, a ball valve, a gate valve, a flapper, or any other suitable means capable of capturing the wireline tool inside of the elongated tube and releasing it as well.

The remote sub sea lubricator further comprises a locking mechanism for securing the remote sub sea lubricator to the sub sea well head. Many types of locking mechanisms can be employed to secure the remote sub sea lubricator to the well head, one type involves a plurality of recesses formed on the outer radial surface of the bottom of the elongated tube formed to receive similarly shaped knobs located on the inner radius of the well head opening.

The remote sub sea lubricator also comprises a means for sealing between its bottom end and the sub sea well head to prevent pressure communication across the region where the outside of the elongated tube contacts the inside of the sub sea well head. The sealing means here will include one or more elastic seals that circumferentially traverse the outer diameter of the bottom end of the elongated tube. The seal dimensions will depend on the dimensions of the bottom end and of the sub sea well head. The seal materials will depend on the environment in which the seals are to be used.

The top end of the remote sub sea lubricator can include a compressible pack off rubber having a coaxially situated axial passage therein formed for passage of a data transmitting wireline therethrough. The top end also includes a pack off bushing and a piston. The piston has a high pressure supply side and an ambient pressure side, where the ambient pressure side is in pressure communication with the inside of the elongated tube. The piston and the pack off bushing both should have a higher modulus of elasticity. The pack off rubber is located between the pack off bushing and the piston. When the high pressure supply side exceeds the ambient pressure side the resulting pressure difference urges the piston toward the pack off bushing which then compresses the pack off rubber between the piston and the pack off bushing. Compression of the pack off rubber causes the axial passage within the pack off rubber to sealingly encase the wireline which then prevents pressure communication through the axial passage.

The present invention also includes a pressurized canister that is in pressure communication with the high pressure supply. Generally, the pressurized canister is pressurized to a pressure of from 200 pounds per square inch to 400 pounds per square inch above the pressure of the well bore. Alternatively, the high pressure supply may be comprised of sub sea hydrostatic pressure. The pressurized canister provides a pressure source to the high pressure side of the piston, where the pressure source can be regulated.

A method of using the remote sub sea lubricator involves inserting a wireline tool into a sub sea well bore comprising the steps of inserting the wireline tool into an elongated tube and securing the wireline tool within the elongated tube. Then the wireline is threaded through the top of the elongated tub, or alternatively a pressure pack off head, and the wireline is connected to the wireline tool. The top of the elongated tube is then attached to the remaining sections of the remote sub sea lubricator. The connection can either be threaded, welded, or flanged.

After the wireline tool is secured within the elongated tube, the elongated tube containing the wireline tool is lowered adjacent to the sub sea well bore. The bottom of the elongated tube is then inserted into the sub sea well head and the elongated tube is secured to the sub sea well head. The wireline tool is then released from the inside of the elongated tube by deactivating the securing means. This allows the wireline tool to be lowered into the sub sea well and for wireline operations to commence. The wireline operations can include well logging, perforating, or other mechanical services as are well known in the art.

Once wireline operations are completed, the wireline tool is raised from inside of the sub sea well back into the elongated tube. The wireline tool is resecured within the elongated tube and the elongated tube is disconnected from the sub sea well. The elongated tube containing the wireline tool is raised up and away from the sub sea well.

DETAILED DESCRIPTION OF THE INVENTION

Figure 1:
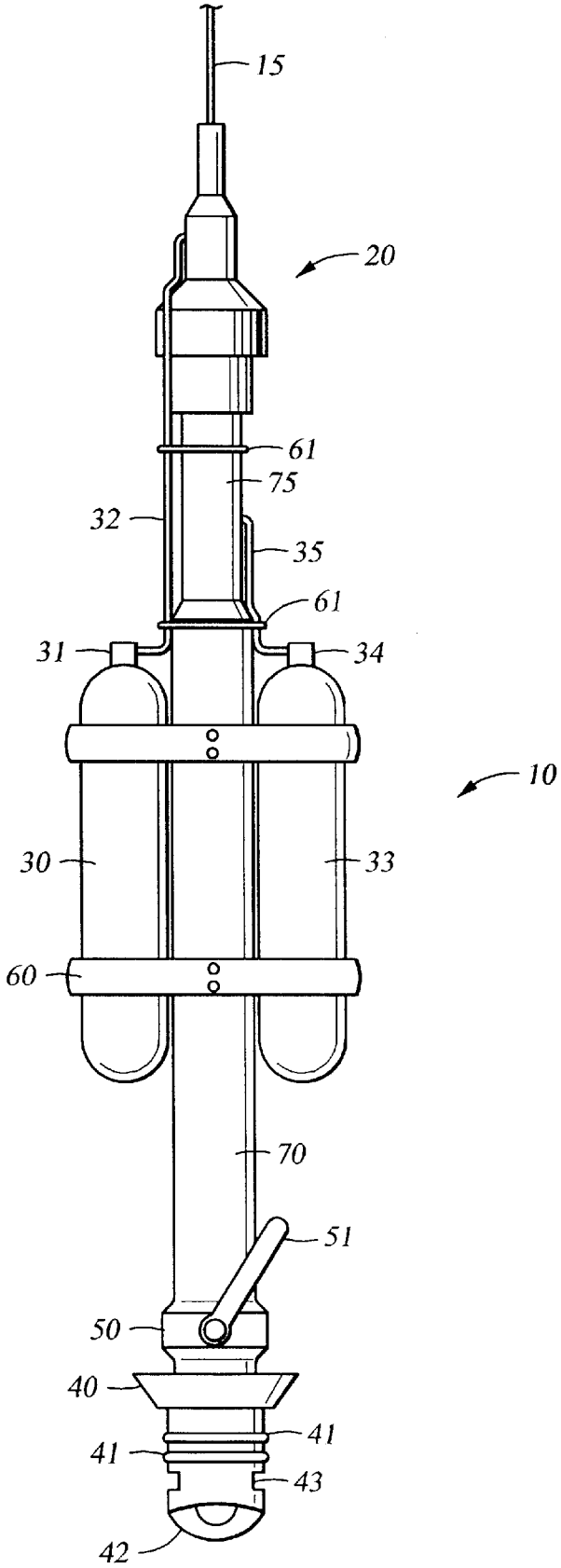
FIG. 1 depicts a side view of the Remote Sub Sea Lubricator.

One of the primary uses of the present invention occurs below the sea surface, therefore in describing the present invention, the terms "top" and "above" mean closer to the sea surface, whereas the terms "bottom" and "below" mean further from the sea surface and therefore closer to the sea floor. With reference to the drawing herein, a Remote Sub Sea Lubricator 10 according to one embodiment of the invention is shown in FIG. 1. The Remote Sub Sea Lubricator 10 typically includes a pack off head 20, an air canister 30, a grease canister 33, a well head adapter 40, a re-entry guide 42, a lubricator 70, a grease injector tube (GIT), and a tool trap 50. Because the invention can be used in a subsea environment, the materials used to fabricate the components must be adequate to withstand the corrosive effects of sea water, production fluids and production gases. Therefore materials such as 4140 steel, or the equivalent, should be used for most of the components. However, engineering judgment should be used to ascertain which material is most suitable for each component.

The lubricator 70 is elongated, hollow, and preferably tubular in shape with a circular cross sectional area. The typical length of the lubricator 70 is approximately 20 feet, but because the lubricator 70 must be capable of housing the wireline tool being used during the specific wireline operations, the length of the lubricator 70 will vary depending on the length of the wireline tool. Therefore, in some cases the length of the lubricator 70 can exceed 100 feet. Further, the inner dimensions of the lubricator 70 must allow free passage of the wireline tool therethrough, thus the inner diameter of the lubricator 70 must be greater than the outer diameter of the wireline tool. Typical inner diameters of the lubricator 70 range from 2 inches to 10 inches, but again the exact dimensions of the lubricator 70 will depend on the dimensions of the wireline tool being used. The wireline tools to be used with the Remote Sub Sea Lubricator 10 include any wireline tool known in the art, such as well logging tools, perforators, or mechanical tools; therefore the wireline operations can include well logging, perforations, or mechanical services, in addition to other wireline services known in the art.

Figure 2:
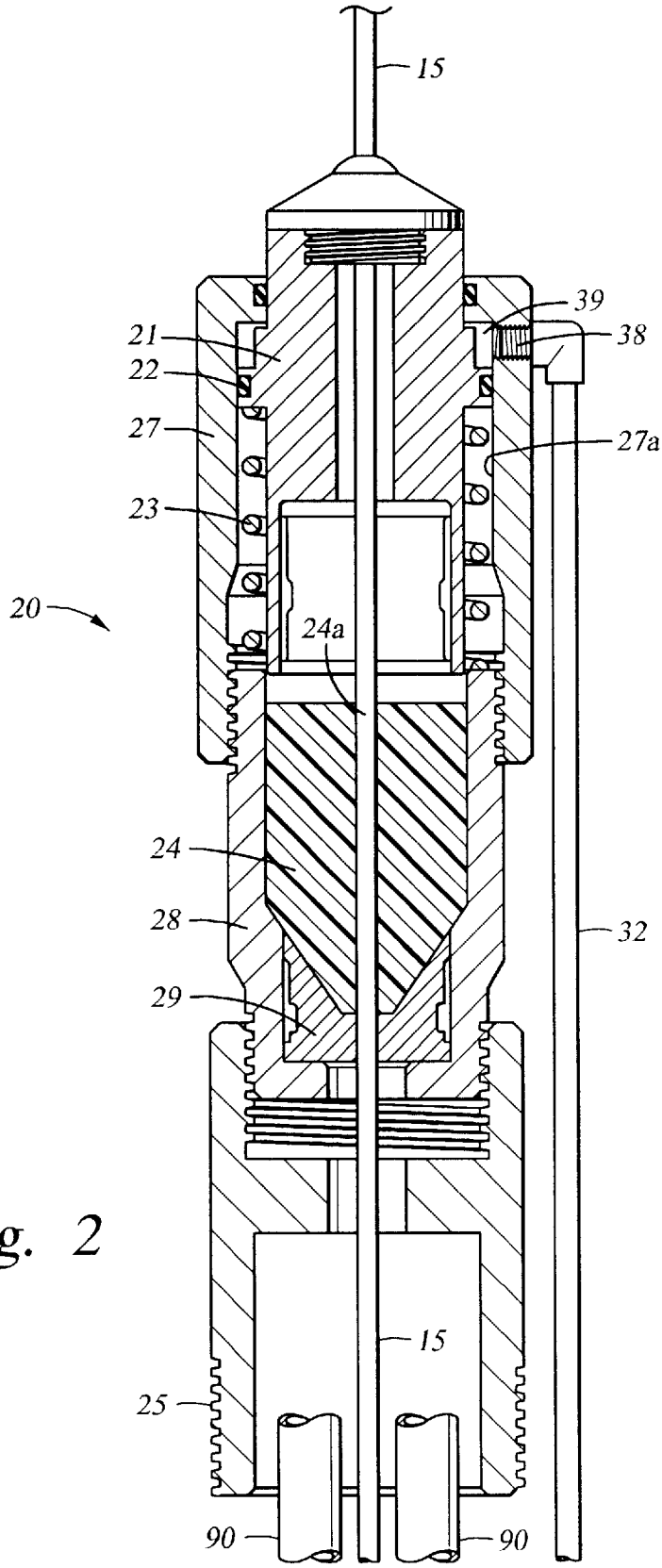
FIG. 2 illustrates a cross section of a pack off head.

Attached to the top of the lubricator 70 is the GIT 75, the GIT 75 is tubular with an inner diameter sized to axially encompass the wireline 15, and a series of flow tubes (not shown). The flow tubes, as is well known in the art, are situated parallel to the wireline 15 inside of the GIT 75 and radially surround the wireline 15. The void between the flow tubes and the wireline 15, as is also well known in the art, is packed with grease. The highly viscous and dense grease situated in the relatively small interstice between the wireline 15 and flow tubes provides a pressure seal along the wireline 15 that prevents pressure communication between the inner radius of the lubricator 70 and above the GIT 75. Mounted on top of the GIT 75 is a pack off head 20 (FIG. 2) that provides an additional pressure seal around the wireline 15. The pack off head 20 is attached at the pack off head connection 25, which situates the pack off head 20 at the top of the GIT 75. While it is preferred that the pack off head 20 be threadedly screwed onto the pack off head connection 25; the pack off head 20 can also be attached onto the pack off head connection 25 by weld or bolt connections, or any other attachment means that is known in the art.

Formed axially within the entire length the pack off head 20 is a passage formed to enable wireline passage therethrough. The wireline can be comprised of a slick line (a solid wire), a conventional wireline, a braided wireline, a conductor tube, or a hollow tube (including coiled tubing). The pack off head 20 is comprised of an upper body 27 and a lower body 28. Both the upper body 27 and the lower body 28 are elongated and preferably have a circular cross section. An axial cavity is formed within both the upper body 27 and the lower body 28, the axial cavities of both bodies also preferably have a circular cross section. The lower end of the lower body 28 is substantially closed, whereas the upper end of the lower body 28 is substantially open. Conversely, the upper end of the upper body 27 is substantially closed, and the lower end of the upper body 27 is substantially open. The upper end of the upper body 27 and the lower end of lower body 28 need to include an opening of sufficient cross sectional area to allow the wireline 15 to freely pass through each opening. The open end of the upper body 27 is attached to the open end of the lower body 28, preferably with a threaded means. However, other suitable connection means as are well known in the art may also be used, such as welding, bolting, or a flanged fitting.

Axially located within the upper body 27 is a piston 21, the piston 21 should be formed to fit coaxially within the cavity of the upper body 27 and have a portion of its outer diameter that is in substantial circumferential contact with the inner wall 27*a* of the upper body cavity. Circumferentially surrounding the piston 21 is a piston seal 22, located at a discrete axial position where the piston 21 is in substantial contact with the inner wall 27*a* of the upper body cavity. The piston seal 22 provides a pressure seal between the area inside of the upper body 27 above the piston seal 22 and below the piston seal 22. The piston seal 22 is preferably comprised of VITON® but can be made of rubber, TEFLON®, or any other suitable material capable of repeatedly performing its sealing function under the harsh sub sea conditions. The piston seal 22 must be able to seal against pressure differentials in excess of 500 psi. The piston 21 also contains an axial passageway which provides for unobstructed passage of the wire line 15 axially through the piston 21.

Above the piston seal 22 is an air reservoir 39 that circumferentially surrounds the piston 21 just above the piston seal 22 forming an annulus there on the outside of the piston 21 and the inside of the upper body 27. A piston spring 23 is located in an annulus formed between the outer diameter of the piston 21 and inside of the upper body 27, below the piston seals 22. The piston spring 23 provides a upward force against the piston 21, thereby urging the piston 21 firmly against the inside of the upper body 27. Formed coaxially within the lower body 28 is a pack off rubber 24. The pack off rubber 24 is included with an axially passage formed therethrough for allowing passage of the wireline 15.

Also included with the Remote Sub Sea Lubricator 10 is an air canister 30 and a grease canister 33, although the Remote Sub Sea Lubricator 10 is illustrated as having one air canister 30 and one grease canister 33, two or more canisters of either air or grease can be included. It is preferred that the air canister 30 and the grease canister 33 be secured to the Remote Sub Sea Lubricator 10 on the lubricator 70 below the pack off head 20 and above the tool trap 50. The canister attachment means 60 illustrated in FIG. 1 is comprised of a pair of bands bolted to the lubricator 70. However, any number of attachment means can be utilized to secure the canisters to the lubricator 70, such as bolting, welding, or brackets. Alternatively, the air canister 30 and the grease canister 33 can be detached from the Remote Sub Sea Lubricator 10 as long as the canisters are able to provide pressure and lubrication to the Remote Sub Sea Lubricator 10.

Both the air canister 30 and the grease canister 33 are pressurized to a pressure above the pressure of the well. Generally the air canister 30 will be pressurized with air from about 200 psi to about 400 psi above the well bore pressure; alternatively the air canister 30 can be filled with nitrogen or some other fluid such as hydraulic fluid at the specified pressure. The grease canister 33 should be pressurized to about 400 psi to about 800 psi above the well bore pressure. However, the pressure differentials of the air canister 30 and the grease canister 33 with respect to the well bore will vary depending on the application, the well conditions, and the type and size of the wireline 15 that is used in conjunction with the Remote Sub Sea Lubricator 10. Further, the canisters can be pressurized before being lowered to the sea floor, or if the Remote Sub Sea Lubricator 10 is being used at a sufficient depth, the hydrostatic pressure of the sea water can be utilized to introduce pressure into the canisters. The manner of pressurizing the canisters is an engineering decision that is to made upon each specific application of the Remote Sub Sea Lubricator 10.

The tool trap 50 is located on the lubricator 70, preferably near the bottom of the Remote Sub Sea Lubricator 10 proximate to the well head adapter 40. The tool trap 50 includes a means for switching between an open and closed position, where the open position allows free passage of the wireline tool through the tool trap 50, and where the closed position provides an obstruction in the tool trap 50 that prevents a wireline tool from passing through. The means can be comprised of a full port ball valve, a ball valve, a gate valve, a flapper, or any other suitable device capable of capturing the wireline tool or stopping the wireline tool from passing through the lubricator 70.

The means for actuating the tool trap 50 open and closed can be comprised of a mechanical or electro-mechanical means affixed to the Remote Sub Sea Lubricator 10 close to or on the tool trap 50. Once such example of a mechanical means for actuating the tool trap 50 open and closed is a lever 51. The lever 51 is to be connected to the capturing device within the tool trap 50 where the capturing device can be manipulated either to an open or closed position by operating the lever 51. It is preferred however that the lever 51 be capable of actuation by a remotely operated vehicle (ROV). Alternatively, a hydraulic system can be used to actuate the tool trap 50 open and closed. The hydraulics actuation means include a hydraulic lines from the ROV providing a motive force to open and close the tool trap 50.

Formed at the bottom of the lubricator 70 is a well head adapter with a re-entry guide 42; the re-entry guide 42 is formed by inwardly tapering the outer edges of the very bottom of the lubricator 70. Inwardly tapering the outer edges of the bottom of the lubricator 70 provides for easier entry of the wireline tool into the lubricator 70. Situated above the re-entry guide 42 and below the tool trap 50 is a well head adapter 40, the well head adapter 40 circumferentially surrounds a portion of the lubricator 70, and has a lower surface which is tapered outward to match the opening of a sub sea well head 80. To ensure that the Remote Sub Sea Lubricator 10 fits into the sub sea well head 80, the well head adapter 40 should be formed to snugly seat into the well head opening 81. On the lubricator 70, in the space between the re-entry guide 42 and the well head adapter 40, there are provided a plurality of well head adapter seals 41. At that location the well head adapter seals 41 circumferentially encircle the lubricator 70 and thereby provide a pressure sealing means across the lubricator 70 in an axial direction. The configuration of the well head adapter 40 and material of the well head adapter seals 41 will depend upon the specific well head the Remote Sub Sea Lubricator 10 will be mated to. The well head adapter seals 41 should be capable of providing a pressure seal between the well bore and the ambient area around the sub sea well head 80.

In operation, the wireline tool to be used in conjunction with the Remote Sub Sea Lubricator 10 will first be inserted into hollow space located within the lubricator 70. Initially the tool trap 50 will be in the closed position, thereby preventing the wireline tool from passing through the lubricator 70. After the wireline tool is placed inside of the lubricator 70, the wireline 15 will be inserted into the top of the pack off head 20 and threaded through the axial passage located within the pack off head 20. At this time the pack off head 20 is not yet attached to the lubricator 70. After the wireline 15 is threaded through the pack off head 20, the wireline 15 will be attached to the wireline tool, and then the pack off head 20 will be secured to the lubricator 70. After the wireline 15 is fastened to the wireline tool, and the pack off head 20 is attached to the lubricator 70, the Remote Sub Sea Lubricator 10 containing the wireline tool can then be lowered to the sea floor for attachment to a sub sea well head 80. Although it is not possible to lower the Remote Sub Sea Lubricator 10 directly into the sub sea well head 80, the Remote Sub Sea Lubricator 10 can be inserted into the sub sea well head 80 with the aid of an ROV. The ROV guides the Remote Sub Sea Lubricator 10 from the surface to the well head where the ROV can mate the Remote Sub Sea Lubricator 10 with the sub sea well head 80 after removing the cap 81 (or top hat as it is known in the art) from the sub sea well head 80. The ROV also works to lock the Remote Sub Sea Lubricator 10 to the sub sea well head 80.

Figure 3:
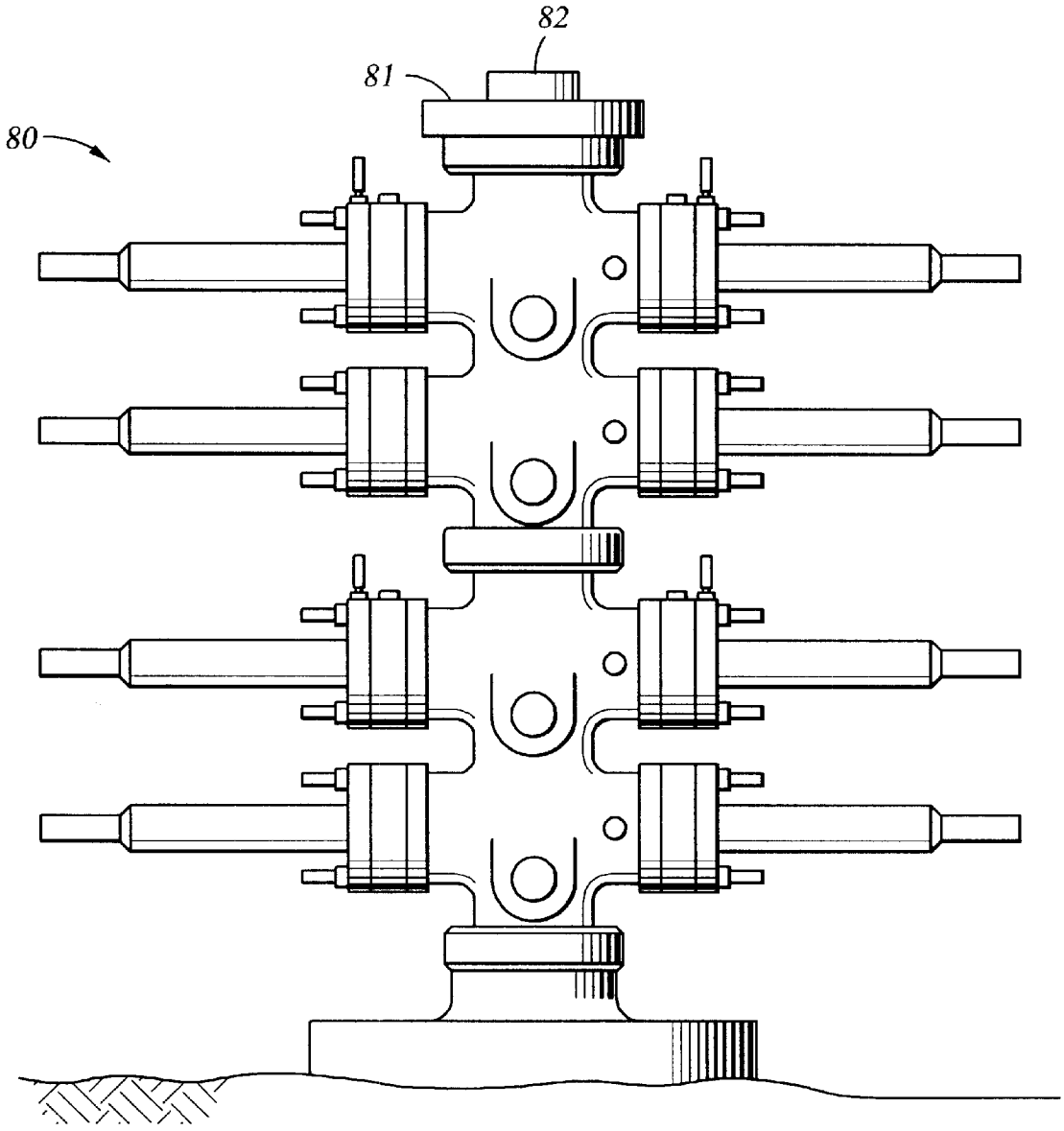
FIG. 3 illustrates on example of a sub sea well head assembly.

The sub sea well head 80 depicted in FIG. 3 is comprised of a series of pipe or shear rams affixed to the well casing on the bottom and having an opening (well head opening 81) at its top. This is one example of the type of well head that can be used in conjunction with the Remote Sub Sea Lubricator 10 of the present invention. While the type of well head to be mated with the Remote Sub Sea Lubricator 10 is not limited to the sub sea well head 80 depicted in FIG. 3, or even limited to conventional sub sea trees, the well head to be used in conjunction with the Remote Sub Sea Lubricator 10 must have an opening that faces upward (a top hub).

The sub sea well head 80 into which the Remote Sub Sea lubricator 10 will be inserted, generally has a well head cap 82 positioned in the well head opening 81. The well head cap 82 is provided to protect the inside of the sub sea well head 80 from the ambient and harsh conditions that exist at the sea floor and to prevent sea water from filling the bore hole. The well head cap 82 of each specific sub sea well head 80 will generally be sized to fit the unique dimensions of the well head opening 81. Because the well head adapter 40 is formed to mate into the well head opening 81, it is important that the well head adapter 40 be formed to match the specific well head opening 81 for each application in which it is used. Because the well head cap 82 is situated in the well head opening 81, the ROV will first remove the well head cap 82 from the sub sea well head 80 then guide the Remote Sub Sea Lubricator 10 into the well head opening 81.

Once the ROV has successfully inserted the Remote Sub Sea Lubricator 10 into the well head opening 81, the Remote Sub Sea Lubricator 10 will be mechanically fastened and attached to the sub sea well head 80 by a locking mechanism 43. Because the well head adapter seals 41 only provide a sealing and not a locking function, a locking mechanism is required to secure the Remote Sub Sea Lubricator 10 to the sub sea well head 80. From FIG. 1 the locking mechanism used is a series of "dogs", which are just one example of a mechanical fastening device that can be implemented to secure the Remote Sub Sea Lubricator 10 to the sub sea well head 80. However, as is well known in the art, any device that secures the Remote Sub Sea Lubricator 10 to the sub sea well head 80 can be used as a locking mechanism. Dogs are recesses formed onto the outer surface of the lubricator 70 to receive similarly shaped knobs that protrude from the inner radius of the well head opening 81.

After the Remote Sub Sea Lubricator 10 is securely fastened to the sub sea well head 80, a pressure test is performed to ensure that Remote Sub Sea Lubricator 10 has a sealing connection to the sub sea well head 80. Following the pressure test, the ROV can acuate the tool trap 50 into the open position and open the well head valves, which allows the wire line tool free passage throughout the entire length of the Remote Sub Sea Lubricator 10, and into the wellbore.

As in all wireline operations, the wireline 15 will axially pass upward and downward through the Remote Sub Sea Lubricator 10. Because the operations occur well beneath the sea surface, it is important that a sealing means be present to reduce or eliminate sea water flow into the wellbore and to prevent well fluids exiting from the wellbore into the sea water. The primary means for sealing against the flow of sea water into the wellbore, and to prevent well fluids from exiting the wellbore into the sea water is comprised of a series of flow tubes 90 inserted axially into the lubricator 70 and surrounding the wireline 15. As is well known in the art, the presence of flow tubes 90 around the wireline 15 coupled with the lubrication filling the voids between the wireline 15 and the flow tubes 90, creates a pressure seal along the wireline 15 that prevents fluid communication between the well bore and the sub sea environment.

The pressure pack off head 20 provides an additional sealing means around the wireline 15. The wireline sealing function is accomplished by the air canister 30 in conjunction with the air pressure regulator 31 and the air line 32. As mentioned above, the air canister 30 is pressurized with air at a pressure well above the wellbore pressure. Connected to the air canister 30 is the air pressure regulator 31, which controls air flow out of the air canister 30 and into the air line 32. After exiting the air pressure regulator 31 the air traveling through the air line 32 will enter into the air reservoir 39 via the air aperture 38. The air pressure inside of the air reservoir 39 will increase until the resulting force applied onto the piston 21 by the increasing air pressure overcomes the resistant force of the spring 23, and urges the piston 21 towards the pack off rubber 24. As noted previously, the fluid within the air canister 30 and the lines between it and the air reservoir 39 can comprise hydraulic fluid. Moreover, the fluid within the air line 32 and air reservoir can be hydraulic fluid that is pressurized by air within the air canister 30.

Continued downward urging of the piston 21 compresses the pack off rubber 24 against the pack off bushing 29. Compressing the pack off rubber 24 reduces the cross sectional area of the rubber inner passage **24*a* and squeezes the rubber inner passage 24*a* tightly around the wireline 15, thus providing a seal to prevent leakage between the inner radius of the pack off rubber 24 and the outer surface of the wireline 15**.

The grease supplied to the GIT 75 must be sufficiently viscous to adhere to the outer surface of the wireline 15 thereby filling voids or interstices that exist between the outer surface of the wireline 15 (as are present in braided wire) and the flow tubes. Depending on the location the Remote Sub Sea Lubricator 10 is being used, the grease must also comply with any local environmental regulations.

In the present invention lubrication, in the form of grease or other suitable lubrication, is provided to the GIT 75 from the grease canister 33 and through the grease line 35. As noted above, the grease canister is pressurized at a pressure above the wellbore pressure. The grease flows from the grease canister 33 through the grease pressure regulator 34 and into the grease line 35. The grease pressure regulator 34 provides a pressure drop from the grease canister 33 to the grease line 35 such that a constant pressure is present inside of the grease line 35. The grease flows through the grease line 35 into the GIT 75.

Once wire line operations are completed, the wire line tool is pulled upward out of the well bore and up above the tool trap 50. After the wire line tool is above the tool trap 50 the ROV can then actuate the tool trap 50 into a closed position. Not only does the tool trap 50 prevent the wireline tool from falling out the bottom of the Remote Sub Sea Lubricator 10, the tool trap 50 also secures any wellbore fluids that collect inside of the Remote Sub Sea Lubricator 10 when it is in fluid communication with the well bore. Securing well bore fluids inside of the Remote Sub Sea Lubricator 10 prevents pollutants from the wellbore from being deposited into the surrounding sea water. Therefore, implementation of the tool trap 50 also prevents potentially environmentally hazardous conditions.

After the tool trap 50 is actuated into a closed position, the ROV will then unlock the Remote Sub Sea Lubricator 10 by manipulating the locking mechanism 43. Once the Remote Sub Sea Lubricator 10 is unlocked from the sub sea well head 80, the entire Remote Sub Sea Lubricator 10 can be lifted from the sub sea well head 80 by retracting the wireline 15. The well head cap 82 can then be replaced into the well head opening 81 by the ROV.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A remote sub sea lubricator assembly for inserting a wireline tool attached to a wireline through a well head and into a sub sea well, where the well head is connected to the sub sea well, comprising:

an elongated tube having an axial passage formed therethrough adapted for receiving the wireline tool having a top end, a bottom end, an inside and an outside whereby the bottom end is formed to coaxially mate said elongated tube with the sub sea well head thereby providing pressure communication between the axial passage of the elongated tube and the well bore; and a cap on the top end of said elongated tube, having an aperture therein for receiving the wireline and having a seal that prevents pressure communication across said aperture when a pressure differential exists across the axis of said seal, wherein said seal comprises, a piston having a high pressure supply side and an ambient pressure side, whereby the ambient pressure side of said piston side is in pressure communication with the inside of said elongated tube, and said piston is coaxial with said elongated tube and provides an axial passage therein formed for passage of a data transmitting wireline therethrough;

a compressible pack off rubber coaxially situated within said top end on the ambient pressure side of said piston, and having an axial passage therein formed for passage of a data transmitting wireline therethrough;

wherein when the pressure of said high pressure supply side exceeds the pressure of the ambient pressure side the pressure difference urges said piston against said pack off rubber thereby compressing said pack off rubber; and wherein compression of said pack off rubber causes said axial passage to sealingly encase the wireline thereby preventing pressure communication through said axial passage.

2. The remote sub sea lubricator of claim 1 wherein said high pressure supply side is in pressure communication with a pressurized canister.

3. The remote sub sea lubricator of claim 2 wherein said pressurized canister is pressurized to a pressure of from 200 pounds per square inch to 400 pounds per square inch above the pressure of the well.

4. The remote sub sea lubricator of claim 1, wherein said high pressure supply side is in pressure communication with sub sea hydrostatic pressure.

5. The remote sub sea lubricator of claim 1 further comprising a pack off bushing disposed between said piston and said pack off rubber wherein when the pressure of said high pressure supply side exceeds the pressure of the ambient pressure side the pressure difference urges said piston toward said pack off bushing thereby compressing said pack off rubber.

6. A method of inserting a wireline tool through a well head and into a sub sea well, where the well head is attached to the sub sea well, comprising the steps of:

inserting the wireline tool into an elongated tube and securing the wireline tool therein;

axially threading a wireline through a tube cap;

connecting the wireline to the wireline tool;

attaching a tube cap to the top of the elongated tube;

lowering the elongated tube containing the wireline tool adjacent to the well head;

inserting the bottom of the elongated tube into the well head;

securing the bottom of the elongated tube to the well head;

releasing the wireline tool from the inside of the elongated tube;

lowering the wireline tool through the well head and into the sub sea well;

raising the wireline tool from inside of the sub sea well into the elongated tube;

securing the wireline tool within the elongated tube;

disconnecting the elongated tube from the well head; and raising the elongated tube containing the wireline tool away from the well head.

7. The method of claim 6 further comprising conducting wireline operations after the wireline tool has been lowered into the sub sea well.

8. The method of claim 7 where the wireline operations is selected from the group consisting of well logging, well perforating, and mechanical services.

9. The method of claim 6 further comprising inserting a seal within said tube cap having opposite ends, axially threading the wireline through said seal, and providing a pressure differential between the ends of said seal to prevent pressure communication across said seal.

10. The method of claim 9 further comprising producing the pressure differential across said seal by providing pressure to one end of said seal from a pressurized canister.

11. The method of claim 9 further comprising producing the pressure differential across said seal by providing pressure to one end of said seal from subsea hydrostatic pressure.

12. A remote sub sea lubricator assembly for use in combination with a wireline tool comprising:

an elongated tube having an axial passage formed therethrough adapted for receiving the wireline tool having a top end, a bottom end, an inside and an outside whereby the bottom end is formed to coaxially mate said elongated tube with the sub sea well head thereby providing pressure communication between the axial passage of the elongated tube and the well bore; and a cap on the top end of said elongated tube, having an aperture therein for receiving the wireline and having a seal that prevents pressure communication across said aperture when a pressure differential exists across the axis of said seal, wherein said seal comprises, a piston having a high pressure supply side and an ambient pressure side, whereby the ambient pressure side of said piston side is in pressure communication with the inside of said elongated tube, and said piston is coaxial with said elongated tube and provides an axial passage therein formed for passage of a data transmitting wireline therethrough;

a compressible pack off rubber coaxially situated within said top end on the ambient pressure side of said piston, and having an axial passage therein formed for passage of a data transmitting wireline therethrough;

wherein when the pressure of said high pressure supply side exceeds the pressure of the ambient pressure side the pressure difference urges said piston against said pack off rubber thereby compressing said pack off rubber; and wherein compression of said pack off rubber causes said axial passage to sealingly encase the wireline thereby preventing pressure communication through said axial passage.

13. The remote sub sea lubricator of claim 12 wherein said high pressure supply side is in pressure communication with a pressurized canister.

14. The remote sub sea lubricator of claim 13 wherein said pressurized canister is pressurized to a pressure of from 200 pounds per square inch to 400 pounds per square inch above the pressure of the well bore.

15. The remote sub sea lubricator of claim 12, wherein said high pressure supply side is in pressure communication with sub sea hydrostatic pressure.

16. A remote sub sea lubricator assembly for inserting a wireline tool attached to a wireline through a well head and into a sub sea well, where the well head is connected to the sub sea well, comprising:

an elongated tube having an axial passage formed therethrough adapted for receiving the wireline tool having a top end, a bottom end, an inside and an outside whereby the bottom end is formed to coaxially mate said elongated tube with the sub sea well head thereby providing pressure communication between the axial passage of the elongated tube and the well bore; and a cap on the top end of said elongated tube, having an aperture therein for receiving the wireline and having a seal that prevents pressure communication across said aperture when a pressure differential exists across the axis of said seal, where the pressure differential is caused by pressure communication between one side of the seal and a pressurized cannister.

17. A remote sub sea lubricator assembly for use in combination with a wireline tool comprising:

an elongated tube having an axial passage formed therethrough adapted for receiving the wireline tool having a top end, a bottom end, an inside and an outside whereby the bottom end is formed to coaxially mate said elongated tube with the sub sea well head thereby providing pressure communication between the axial passage of the elongated tube and the well bore; and a cap on the top end of said elongated tube, having an aperture therein for receiving the wireline and having a seal that prevents pressure communication across said aperture when a pressure differential exists across the axis of said seal, where the pressure differential is caused by pressure communication between one side of the seal and a pressurized cannister.

* * * * *